US005275927A

United States Patent [19]

Pham et al.

[11] Patent Number: 5,275,927

[45] Date of Patent: Jan. 4, 1994

[54] PHOTOTHERMOGRAPHIC ARTICLES CONTAINING NOVEL BARRIER LAYERS

[75] Inventors: Oanh V. Pham; Thomas J. Ludemann, Maplewood, Minn.

[73] Assignee: Minnesota Mining and Manufacturing Company, Saint Paul, Minn.

[21] Appl. No.: 913,804

[22] Filed: Jul. 16, 1992

[51] Int. Cl.[5] ..... G03C 8/00; G03C 1/76

[52] U.S. Cl. ..... 430/536; 430/203; 430/214; 430/215; 430/523; 430/961

[58] Field of Search ..... 430/203, 212, 213, 214, 430/215, 523, 961, 536, 505; 428/515

[56] References Cited

U.S. PATENT DOCUMENTS

| | | | |
|---|---|---|---|
| 2,761,791 | 9/1956 | Russell | 1127/34 |
| 3,382,214 | 5/1968 | Haas | 430/213 |
| 3,700,458 | 10/1972 | Lindholm | 96/114.1 |
| 3,785,830 | 1/1974 | Sullivan et al. | 96/114.1 |
| 4,021,240 | 5/1977 | Cerquone et al. | 96/29 D |
| 4,021,250 | 5/1977 | Sashihara et al. | 96/114.1 |
| 4,022,617 | 5/1977 | McGuckin | 96/29 D |
| 4,123,274 | 10/1978 | Knight et al. | 96/66 T |
| 4,220,709 | 9/1980 | deMauriac | 430/353 |
| 4,368,247 | 1/1983 | Fletcher, Jr. et al. | 430/17 |
| 4,370,401 | 1/1983 | Winslow et al. | 430/178 |
| 4,374,921 | 2/1983 | Frenchik | 430/338 |
| 4,452,883 | 6/1984 | Frenchik et al. | 430/502 |
| 4,460,681 | 7/1984 | Frenchik | 430/502 |
| 4,478,927 | 10/1984 | Naito et al. | 430/203 |
| 4,594,307 | 6/1986 | Ishida | 430/203 |
| 4,770,989 | 9/1988 | Komamura et al. | 430/203 |
| 4,923,792 | 5/1990 | Grieve et al. | 430/559 |
| 4,990,434 | 2/1991 | Van Thillo et al. | 430/536 |
| 5,194,361 | 3/1993 | Taguchi | 430/215 |
| 5,202,223 | 4/1993 | Shibara et al. | 430/523 |

FOREIGN PATENT DOCUMENTS

| | | |
|---|---|---|
| 119615A2 | 3/1984 | European Pat. Off. . |
| 51-104338 | 9/1976 | Japan . |
| 59-165054 | 9/1984 | Japan . |
| 59-168439 | 9/1984 | Japan . |
| 837095 | 6/1960 | United Kingdom . |

OTHER PUBLICATIONS

T. H. James in *The Theory of the Photographic Process*, Fourth Ed.; MacMillan: New York, 1977; pp. 149–169; Ibid, p. 374.

*Research Disclosures* No. 17029.

*The Colour Index*; The Society of Dyes and Colourists: Yorkshire, England, 1971; vol. 4, p. 4437.

K. Venkataraman in *The Chemistry of Synthetic Dyes*; Academic Press; New York, 1952; vol. 2, p. 1206.

F. M. Hamer in *The Cyanine Dyes and Related Compounds*; Interscience Publishers: New York, 1964; p. 492.

F. X. Smith et al., *Tetrehedron Lett.* 1983, 24(45), pp. 4951–4954.

X. Huang and L. Xe, *Synthetic Communications* 1986, 16(13), pp. 1701, 1707.

H. Zimmer et al., *Journal of Organic Chemistry* 1960, 25, pp. 1234–1235.

M. Sekiya et al., *Chem. Pharm. Bull.* 1972, 20(2), p. 343.

T. Sohda et al., *Chem. Pharm. Bull.* 1938, 31(2), pp. 560–565.

"Polymer Handbook", 2nd Edition (edited by J. Brandrup and E. H. Immergut, published by John Wiley and Sons, Inc.).

*Primary Examiner*—Charles L. Bowers, Jr.
*Assistant Examiner*—James Pasterczyk
*Attorney, Agent, or Firm*—Gary L. Griswold; Walter N. Kirn; Gregory A. Evearitt

[57] ABSTRACT

Photothermographic articles containing interfacial barriers comprising a layer of a polymeric organic acid containing carboxyl and/or sulfo groups in direct contact with an adjacent layer comprising a basic polymer capable of forming hydrogen bonds with the polymeric organic acid are disclosed. A crosslinked barrier is formed at the interface between the layers which has substantial impermeability to chemical diffusion.

7 Claims, No Drawings

PHOTOTHERMOGRAPHIC ARTICLES CONTAINING NOVEL BARRIER LAYERS

FIELD OF THE INVENTION

This invention relates to imageable articles and more particularly, this invention relates to photothermographic articles which contain barrier layers composed of interpolymer complexes.

BACKGROUND OF THE ART

Multilayer imageable articles are known in the art with various color-forming layers separated from each other by barrier interlayers. Additionally, it is common practice in the imageable arts to apply a protective barrier layer to the top surface of an imageable construction in order to prevent abrasion and environmental deterioration of the imageable construction. In both of these applications, impermeability to chemical diffusion is an important factor in determining the success of the barrier layer.

Photothermographic articles having at least two or three distinct color image-forming layers are disclosed in U.S. Pat. Nos. 4,021,240 and 4,460,681. The barrier layers are "functional" when ingredients active in the formation of color are included therein. The layers are considered "non-functional" when no ingredients active in the formation of dye images or silver images are included within that layer.

U.S. Pat. No. 4,021,240 discloses the use of interlayers of polyvinyl alcohol for preserving the integrity of multiple color-forming layers. Other hydrophilic polymers, such as gelatin, are also disclosed as being useful. The use of other synthetic polymeric binders, alone or in combination, as vehicles or binding agents in various layers is described. Useful resins such as polyvinyl butyral, cellulose acetate butyrate, polymethyl methacrylate, ethyl cellulose, polystyrene, polyvinyl chloride, chlorinated rubber, butadiene-styrene copolymers, and vinylchloride-vinyl acetate copolymers are also disclosed.

SUMMARY OF THE INVENTION

By the present invention, it has now been discovered that effective barrier layers to chemical diffusion of ingredients between the imaging layers of an imageable article may be made by coating a layer comprising a polymeric organic acid containing carboxyl and/or sulfo groups adjacent to a layer comprising a basic polymer capable of forming hydrogen bonds with the carboxyl and/or sulfo groups of the polymeric organic acid. The resulting crosslinked, hydrogen bonded structure can be chemically termed "an interpolymer complex."

Thus, the present invention provides an imageable article comprising a layer comprising an acidic polymer containing carboxyl and/or sulfo groups, the layer being adjacent to another layer comprising a basic polymer capable of forming hydrogen bonds with the polymeric acid.

In one possible arrangement, the above-disclosed adjacent polymeric layers are internal to the imageable article. In another possible arrangement, the above-disclosed adjacent polymeric layers are the outermost coating layer of the imageable article.

Preferably, the imageable articles of this invention are composed of dry silver layers.

As used herein:

"Carboxyl" means —COOH;

"Sulfo" means —$SO_3H$;

"Dry silver imaging layer" means a photothermographic imaging layer comprising light-sensitive silver halide; light-insensitive, reducible, silver source material; and reducing agent for silver ion.

"Hydrogen bond", as is well understood, means a bond between a hydrogen atom bonded to an electronegative atom, and a second electronegative atom. Both electronegative atoms are usually N, O, or F.

"Interpolymer complex" means the resulting structure formed between adjacent acidic and basic polymer layers through hydrogen bonding.

The imageable articles of the present invention contain interpolymer complexes as a result of hydrogen bonding between the adjacent acidic and basic polymer layers. The interpolymer complex results in a crosslinked barrier at the interface between the adjacent polymer layers that exhibits both substantial impermeability to chemical diffusion of ingredients between dry silver layers and improved adhesion at the interface.

Other aspects, advantages, and benefits of the present invention are apparent from the detailed description, examples, and claims.

DETAILED DESCRIPTION OF THE INVENTION

Interpolymer Complex

Imageable articles of the present invention comprise a substrate and an imageable layer coated on the substrate. In a preferred embodiment, multiple imageable layers are coated on the substrate separated by interlayers. Optionally, a protective barrier layer may be superposed on the imageable layer coated farthest from the substrate. The interfacial layers of the imageable articles of the present invention occur at the boundary or interface between a layer comprising a polymeric organic acid containing carboxyl and/or sulfo groups and an adjacent layer comprising a basic polymer capable of forming hydrogen bonds with the polymeric organic acid. The resultant crosslinked interpolymer complex helps control chemical diffusion from one imaging layer to another and provides improved adhesion at the interface.

The acidic polymer contains carboxyl and/or sulfo groups which can undergo hydrogen bonding to the basic polymer which contains heteroatoms such as N, O, or F. Non-limiting examples of acidic polymers which can be utilized in the present invention include, but are not limited to, polyacrylic acid and polymethacrylic acid. Examples of basic polymers include, but are not limited to, polyvinylpyrrolidone and polyvinylpyridine.

In one possible arrangement, the above-disclosed adjacent layers are internal to the inventive imageable article. In another possible arrangement, the above-disclosed adjacent layers are the outermost coating layer of the imageable article.

The interfacial barriers (formed of interpolymer complexes) used in the imageable articles of the present invention are useful in many imaging applications and are particularly suited to applications in which chemical diffusion is detrimental between imaging layers. Therefore, while single color applications are envisioned, the greatest benefit of the present invention may be obtained in multiple or full color applications. Particularly well suited applications of the present invention are those in which the imageable layers are dry silver layers.

Imageable Layer

The imageable layer(s) may be of any type known in the imaging arts. Preferably the imageable layers are those in which a colored dye image is formed. More preferably, the imageable layers are those in which a colored dye image is formed by oxidation of a neutral leuco dye to form a cationic image.

In a preferred embodiment, the imageable layer(s) comprises a dry silver composition comprising an intimate mixture of a light-sensitive silver halide; a light-insensitive, reducible silver source such as a silver salt of an organic acid (e.g., silver behenate, silver saccharine, or silver imidazolate); and a reducing agent for the reducible silver source. Normally, dry silver compositions further comprise a spectral sensitizer. Such a mixture is usually prepared in a solvent as a dispersion that is spread as a layer on a suitable substrate. When dry, the layer is exposed to a light image and thereafter, a reproduction of the image is developed by heating the coated substrate.

A dry silver layer may be prepared, for example, by first dispersing a light-sensitive silver halide; a silver salt of an organic acid; and a reducing agent for silver ion and then spreading the resultant dispersion on a suitable substrate. In order to promote intimate contact of the silver salt of an organic acid and the light-sensitive silver halide, it is effective to prepare both ingredients separately and then mix the two in a ball mill for a long time. Another effective method for promoting intimate contact of the silver salt of an organic acid and the light-sensitive silver halide comprises adding a halogen-containing compound to the prepared organic silver salt oxidizing agent and forming silver halide by the reaction of the halogen-containing compound with silver in the organic silver salt oxidizing agent.

Dry silver layers of the invention may comprise a single coated layer or a plurality of sequentially coated sublayers with the various constituent components. Alternatively, the image-receiving layer may be supplied as an external component carried on a second substrate; that is, it can be brought into contact (i.e., laminated) with a first substrate bearing an image-forming layer during processing such that a dye image is transferred from the first substrate to the image-receiving layer. In that case, the laminated construction constitutes an imaged construction according to the present invention.

Silver Halide

Silver halides known to those skilled in the art for use in photothermography are useful in the present invention and include, but are not limited to, silver chloride, silver chlorobromide, silver chloroiodide, silver bromide, silver iodobromide, silver chloroiodobromide, and silver iodide.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. Details thereon are described in James, T. H. *The Theory of the Photographic Process*, Fourth Ed.; MacMillan: New York, 1977; pp. 149-169.

The light sensitive silver halide used in the present invention can be typically employed in a range of from about 0.01 to 15.0 percent by weight of the dry silver layer and preferably, from about 0.1 to 1.0 weight percent.

Sensitizer

The sensitizer, if employed, may be any dye known in the photographic arts to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes, and complex merocyanine dyes are particularly useful. Examples of suitable sensitizers are those disclosed in U.S. Pat. No. 4,370,401.

An appropriate amount of a sensitizing dye added is generally in the range of about $10^{-10}$ to $10^{-1}$ mole, and preferably from about $10^{-8}$ to $10^{-3}$ mole, per mole of silver halide.

Light-Insensitive, Reducible Silver Sources

The light-insensitive, reducible silver sources that can be used in the present invention are silver salts that are comparatively stable to light and which form a silver image by reacting with the above described leuco compound or an auxiliary developing agent that is coexisting with the leuco compound, if desired, when heated to a temperature of above 80° C., and preferably, above 100° C. in the presence of exposed silver halide. Suitable organic silver salts include silver salts of organic compounds having a carboxylate group. Preferred examples thereof include silver salts of aliphatic and aromatic carboxylic acids. Preferred examples of silver salts of aliphatic carboxylic acids include silver behenate, silver stearate, silver oleate, silver laurate, silver caproate, silver myristate, silver palmitate, silver maleate, silver fumarate, silver tartarate, silver linoleate, silver butyrate and silver camphorate, and mixtures thereof. Silver salts that are substituted with a halogen atom or a hydroxyl group can also be effectively used. Preferred examples of silver salts of aromatic carboxylic acids and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, etc., silver gallate, silver tannate, silver phthalate, silver terephthalate, silver salicylate, silver phenylacetate, silver pyromellitate, silver salts of 3-carboxymethyl-4-methyl-4-thiazoline-2-thiones or the like as described in U.S. Pat. No. 3,785,830; and silver salts of aliphatic carboxylic acids containing a thioether group as described in U.S. Pat. No. 3,330,663, etc. Silver salts of compounds containing mercapto or thione groups and derivatives thereof can be used. Preferred examples of these compounds include silver 3-mercapto-4-phenyl-1,2,4-triazolate, silver 2-mercaptobenzimidazolate, silver 2-mercapto-5-aminothiadiazolate, silver 2-(S-ethylglycolamido)benzothiazolate; silver salts of thioglycolic acids such as silver salts of S-alkyl thioglycolic acids (wherein the alkyl group has from 12 to 22 carbon atoms); silver salts of dithiocarboxylic acids such as silver dithioacetate, silver thioamidoate, silver 1-methyl-2-phenyl-4-thiopyridine-5-carboxylate, silver triazinethiolate, silver 2-sulfidobenzoxazole; and silver salts as described in U.S.

Pat. No. 4,123,274. Furthermore, silver salts of a compound containing an amino group can be used. Preferred examples of these compounds include silver salts of benzotriazoles, such as silver benzotriazolate; silver salts of alkyl-substituted benzotriazoles such as silver methylbenzotriazolate, etc.; silver salts of halogen-substituted benzotriazoles such as silver 5-chlorobenzotriazolate, etc.; silver salts of carboimidobenzotriazoles, etc.; silver salts of 1,2,4-triazoles and 1-H-tetrazoles as described in U.S. Pat. No. 4,220,709; silver salts of imidazoles; and the like.

The silver halide and the organic silver salt that form a starting point of development should be in reactive association (i.e., in the same layer, in adjacent layers, or layers separated from each other by an intermediate layer having a thickness of less than 1 micron). It is preferred that the silver halide and the organic silver salt be present in the same layer.

The silver halide and the organic silver salt that are separately formed in a binder can be mixed before use to prepare a coating solution, but it is also effective to blend both of them in a ball mill for a long time. Further, it is effective to use a process which comprises adding a halogen-containing compound in the organic silver salt prepared to partially convert the silver of the organic silver salt to silver halide.

Methods of preparing these silver halide and organic silver salts and manners of blending them are described in *Research Disclosures* No. 17029 and U.S. Pat. No. 3,700,458.

A suitable coating amount of the light-sensitive silver halide and the organic silver salt employed in the present invention is in a total from 50 mg to 10 g/m$^2$ calculated as an amount of silver as disclosed, for example, in U.S. Pat. No. 4,478,927.

The light-insensitive, reducible silver source is preferably employed in an amount of from about 0.1–50 weight percent, and more preferably from about 1–5 weight percent, based upon the total weight of each imaging layer in which the silver source is present.

Leuco Dye

Suitable leuco dyes for use in the present invention are compounds that oxidize to form a dye image. Preferably, at least one imaging layer should comprise a leuco form of a cationic dye and at least one other imaging layer should comprise a leuco form of a neutral dye.

Preferred neutral leuco dyes are phenolic leuco dyes such as 2-(3,5-di-t-butyl-4-hydroxyphenyl)-4,5-3-diphenylimidazole or bis(3,5-di-t-butyl-4-hydroxyphenyl)phenylmethane. Some phenolic leuco dyes useful in practice of the present invention are disclosed in U.S. Pat. Nos. 4,374,921; 4,460,681; 4,594,307; and 4,780,010, which are incorporated herein by reference.

The leuco dyes used in the present invention may be any colorless or lightly colored compound that forms a visible dye upon oxidation. The compound must be oxidizable to a colored state. Compounds that are both pH sensitive and oxidizable to a colored state are useful, but not preferred, while compounds only sensitive to changes in pH are not included within the term "leuco dyes" since they are not oxidizable to a colored form. The dyes formed from the leuco dye in the various color-forming layers should, of course, be different. A difference of at least 60 nm in reflective maximum absorbance is preferred and more preferably, the absorbance maximum of dyes formed will differ by at least 80–100 nm. When three dyes are to be formed, two should preferably differ by at least these minimums and the third should preferably differ from at least one of the other dyes by at least 150 nm and more preferably, by at least 200 nm. Any leuco dye capable of being oxidized by silver ion to form a visible dye is useful in the present invention as previously noted. Leuco dyes such as those disclosed in U.S. Pat. Nos. 3,442,224; 4,021,250; 4,022,617; 4,368,247; 4,370,401; and 4,594,307 are also useful in the present invention.

Other leuco dyes may be used in imaging layers as well, such as, for example, benzylidene leuco compounds disclosed in U.S. Pat. No. 4,923,792. The reduced form of the dyes should absorb less strongly in the visible region of the electromagnetic spectrum and be oxidized by silver ions back to the original colored form of the dye. Benzylidene dyes have extremely sharp spectral characteristics giving high color purity of low gray level. The dyes have large extinction coefficients, typically in the order of $10^4$ to $10^5$, and possess good compatibility and heat stability. The dyes are readily synthesized and the reduced leuco forms of the compounds are very stable.

The dyes generated by the leuco compounds employed in the imageable articles of the present invention are known and are disclosed, for example, in *The Colour Index*; The Society of Dyes and Colourists: Yorkshire, England, 1971; Vol 4, p. 4437; and Venkataraman, K. *The Chemistry of Synthetic Dyes*; Academic Press: New York, 1952; Vol. 2, p. 1206; U.S. Pat. No. 4,478,927; and Hamer, F. M. *The Cyanine Dyes and Related Compounds*; Interscience Publishers: New York, 1964; p. 492.

The leuco compounds may readily be synthesized by techniques known in the art. There are many known methods of synthesis from precursors since the reaction is a simple two step hydrogen reduction. Suitable methods are disclosed, for example, in F. X. Smith et al. *Tetrahedron Lett.* 1983, 24(45), pp. 4951–4954; X. Huang. L. Xe, *Synth. Commun.* 1986, 16(13) pp. 1701–1707; H. Zimmer et al. *J. Org. Chem.* 1960, 25, pp. 1234–5; M. Sekiya et al. *Chem. Pharm. Bull.* 1972, 20(2), p. 343; and T. Sohda et al. *Chem. Pharm. Bull.* 1983, 31(2) pp. 560–5.

Further, as other image forming materials, materials where the mobility of the compound having a dye part changes as a result of an oxidation-reduction reaction with silver halide or an organic silver salt at high temperature can be used, as described in Japanese Kokai No. 59-165054. Many of the above described materials are materials wherein an image-wise distribution of mobile dyes corresponding to exposure is formed in the light-sensitive material by heat development. Processes of obtaining visible images by transferring the dyes of the image to a dye fixing material (diffusion transfer) have been described in Japanese Kokai Nos. 59-168,439 and 59-182,447.

The total amount of leuco dye utilized in the present invention should preferably be in the range of about 1–50 weight percent, and more preferably in the range of about 5–20 weight percent, based upon the total weight of each individual imaging layer in which the leuco dye(s) is (are) employed.

When the heat developable, light-sensitive material used in this invention is heat developed in a substantially water-free condition after or simultaneously with image-wise exposure, a mobile dye image is obtained simultaneously with the formation of a silver image either in exposed areas or in unexposed areas with exposed light-sensitive silver halide. The light-sensitive silver halide and the organic silver salt oxidizing agent used in the present invention are generally added to at least one binder as described below. Further, the dye releasing redox compound is dispersed in the binder(s) described below.

The binder(s) that can be used in the present invention can be employed individually or in combination. The binder(s) may be hydrophilic or hydrophobic. A typical hydrophilic binder is a transparent or translucent hydrophilic colloid, examples of which include a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic material.

Preferably, the polymeric binder is present in an amount in the range of from about 1–99 weight percent and more preferably, from about 20–80 weight percent of each imaging layer in which the binder is employed. The coating amount of the binder used in the present invention is 20 g or less per $m^2$; preferably 10 g or less per $m^2$; and more preferably 7 g or less per $m^2$.

In the photographic light-sensitive material and the dye fixing material of the present invention, the photographic emulsion layer and other binder layers may contain inorganic or organic hardeners. It is possible to use chromium salts such as chromium alum, chromium acetate, etc.; aldehydes such as formaldehyde, glyoxal, glutaraldehyde, etc.; N-methylol compounds such as dimethylolurea, methylol dimethylhydantoin, etc.; dioxane derivatives such as 2,3-dihydroxydioxane, etc.; active vinyl compounds such as 1,3,5-triacryloylhexahydro-s-triazine, 1,3-vinylsulfonyl-2-propanol, etc.; active halogen compounds such as 2,4-dichloro-6-hydroxy-s-triazine, etc.; mucohalogenic acids such as mucochloric acid, mucophenoxychloric acid, etc.; and combinations thereof.

In one embodiment of the present invention, dyes generated during thermal development of light-exposed regions of the emulsion layers migrate under development conditions into a dye-receiving layer wherein they are retained. The dye-receiving layer may be coated directly on the substrate on the same side as the imageable layer(s) or it may be coated between imageable layers or superposed on the imageable layer coated farthest from the substrate. The dye receiving layer may be composed of a polymeric material having affinity for the dyes employed. Necessarily it will vary depending on the ionic or neutral characteristics of the dyes.

Examples of organic polymeric materials used in the dye-receiving material of this invention include polystyrene having a molecular weight of 2,000 to 85,000, polystyrene derivatives having substituents with not more than 4 carbon atoms such as poly(vinylcyclohexene)andpoly(divinylbenzene),poly(N-vinylpyrrolidine), poly(N-vinylcarbazole), poly(allybenzene), polyvinyl alcohol, polyacetals such as polyvinyl formal and polyvinyl butyral, polyvinyl chloride, chlorinated polyethylene, polytrifluoroethylene, polyacrylonitrile, poly(N,N-dimethylallylamide), polyacrylates having a p-cyanophenyl group, a pentachlorophenyl group or a 2,4-dichlorophenyl group, poly(acryl chloroacrylate), poly(methyl methacrylate), poly(ethyl methacrylate), poly(propyl methacrylate), poly(isopropyl methacrylate), poly(isobutyl methacrylate), poly(tert-butyl methacrylate), poly(cyclohexyl methacrylate), polyethylene glycol dimethacrylate, poly(cyanoethyl methacrylate), polyesters such as polyethylene terephthalate, polysulfone Bisphenol A polycarbonate, polycarbonates, polyanhydrides, polyamides, and cellulose acetate. The synthetic polymers described in "Polymer Handbook", 2nd Edition (edited by J. Brandrup and E. H. Immergut, published by John Wiley and Sons, Inc.) are also useful. These polymeric substances may be used singly or a plurality of them may be used in the form of a copolymer.

Interlayers

In addition to the barrier interlayers comprising interpolymer complexes, as disclosed earlier herein, conventional barrier layers, as known to those skilled in the art, may also be employed in the practice of the present invention. Such conventional barrier interlayers employed in the present invention are selected from polymeric materials that are selectively permeable to dyes used to form the developed image. They are preferably coated from solvents in which the previously coated emulsion layer is not soluble. These polymers can be used as interlayers in construction of an at least two, and preferably an at least three, color photothermographic color recording system. This type of construction with the proper-solvent selection is conducive to the use of simultaneous multiple coating techniques with good color separation and enables the simultaneous thermal development of at least two or at least three individual color forming photothermographic system having different chemistry, but similar thermal properties.

This technology enables one to construct a three-color photothermographic recording system capable of recording color (electronic) phosphor light output or other color light output and giving a color reproduction within as little as a 10 second development at 120° to 150° C.

The term "organic solvent soluble" used to describe the barrier layers requires that the polymer used as the barrier layer be directly soluble in an organic solvent.

This definition clearly excludes such materials as polyvinyl alcohol which, if it is to be dissolved in an alcohol (one of the few organic materials which it can be dissolved in), must first be dissolved in water and heated. Gelatin would also be clearly excluded, but polyvinylpyrrolidone (soluble in either water or organic solvents) would be included. The use of organic solvent soluble barrier layers has numerous improvements over water soluble layers. For example, (a) the organic leuco dyes cannot be dissolved in the barrier layers which is a desirable alternative, (b) polyvinyl alcohol will not wet the other polymer layers and tends to separate, (c) polyvinyl alcohol is not conducive to simultaneous coating with the organic solvent soluble adjacent layers, and (d) water soluable layers tend to absorb moisture which is evaporated during thermal development and can form unsightly spots within or between the layers. This invention preferably uses a three color system of yellow, magenta, and cyan color formation based on the heat induced oxidation/reduction reaction between (a) the light exposed silver halide and reducible, light-insensitive, silver source (preferably the silver salt of a fatty acid that is in catalytic proximity to silver halide, preferably by halidization, and is dye sensitized to a specific wavelength of radiation) and (b) a chromogenic developer. The yellow color forming system is blue sensitive and is generally coated first out of a solvent. This system consists of two coatings, a silver containing first layer and then a second layer whose polymer is impervious to the solvent in the second color system applied, preferably toluene or toluene and alcohol. The developer preferably can either be a diphenol derivative or a triarylimidazole whose oxidative product is yellow. This system uses a combination of phthalazine or phthalazinone with phthalic acid or one of its derivatives. The second layer "barrier" polymers may be, for example, maleic anhydride/vinyl methyl ether copolymers, polyvinylidiene chloride, or polyvinylpryrrolidone. The preferred polymers are maleic acid copolymers such as alkyl monoesters of poly(methyl vinyl ether/maleic acid). The magenta color forming system is green sensitive and is usually coated second out of a different solvent system than the first two layers and one which is not able to penetrate the first barrier layer (for example, a solvent such as 90% toluene and 10% ethanol is used). This also consists of two coatings, the first being the silver and the second layer containing a polymer that is impervious to the solvent of the third color system applied, preferably alcohol. The developer is preferably a leuco indoaniline dye whose oxidative product is magenta. This system preferably uses a toner combination of phthalazine, phthalic acid or its derivatives, and tetrachlorophthalic acid. Phthalazinone can be used in place of, or in addition to, phthalazine that can also be used alone.

The test for determining if an interlayer polymer is impermeable to the solvent of the next layer can be simply performed. First, a layer is coated containing a sensitized, halidized silver salt of a fatty carboxylic (for example, 10–32 carbon atoms and preferably, 12–29 carbon atoms) acid and polyvinyl butryal polymer. A second coating of the candidate interlayer polymer is applied after the first coating has dried. The last layer contains the appropriate solvent, a color forming developer, and toner reactant. The dried coatings are given an excessive light exposure and then heated for 60 seconds at 120°–140° C. The test is positive if no color or image is formed.

In another preferred embodiment of the present invention, interlayers comprising a styrene-vinylidene chloride copolymer may be employed in order to prevent diffusion of cationic compounds not resulting from oxidation of leuco dyes. Examples of these compounds are sensitizing dyes, coating aids, and the like.

Protective Barrier Layer

The imageable articles of the present invention may be overcoated with a protective barrier layer coating. Suitable materials for the protective barrier layer include, but are not limited to, polymers that are insoluble in aqueous systems, soluble in some organic solvents, and impervious to certain other organic solvents. The "barrier" polymer, which is the fourth layer and preferably contains the color reactants, is normally a methyl methacrylate polymer, copolymer, or blend with other polymers or copolymers (for example copolymers with n-butyl acrylate, butyl methacrylate, and other acrylates such as acrylic acid, methacrylic acid, acrylic anhydride, and the like), polystyrene, or a combination of a polyvinyl chloride tripolymer with a butadiene-styrene copolymer. The barrier layer may be crosslinked also. This would be preferably done by the inclusion of a latent or activatable crosslinking agent. Crosslinking could then be effected after coating.

The theory of this process is essentially the same for a light-sensitive material comprising a negative emulsion and a light-sensitive material comprising a direct positive emulsion and differs only in that the portion to be developed is an exposed area in one and an unexposed area in the other. Accordingly, even when a direct positive emulsion is used, a dye image providing good color reproducibility is obtained in the same way as in the case of a negative emulsion.

Heating in a substantially water-free condition, as used herein, means heating at a temperature of 80° to 250° C. The term "substantially water-free condition" means that the reaction system is in equilibrium with water in the air, and any water necessary for inducing or promoting the reaction is not particularly or positively supplied from exterior to the element. Such a condition is described at page 374 of "The Theory of the Photographic Process", 4th Edition (T. H. James, published by MacMillan Co.).

The photographic emulsion layer and other hydrophilic colloid layers that are used in the light-sensitive material of the present invention may contain surface active agents for various purposes, for example, as coating aids or for prevention of electrical charging, improvement of lubricating properties, emulsification, prevention of adhesion, improvement of photographic properties (for example, acceleration of development providing hard tones or sensitization), etc. For example, it is possible to use nonionic surface active agents such as saponin (steroid), alkylene oxide derivatives (for example, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkyl amines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxyl group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkyl phenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkyl betaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a repeating unit of ethylene oxide in their molecules are often preferably incorporated into the light-sensitive material. It is particularly preferred that the molecule contains five or more of the recurring units of ethylene oxide.

The nonionic surface active agents capable of satisfying the above described conditions are well known as to their structures, properties, and methods of synthesis. These nonionic surface active agents are widely used even outside the field of the present invention. A representative reference relating to these agents is *Nonionic Surfactants*; Schick, M. J., Ed.; Surfactant Science Series; Marcel Dekker: New York, 1967; Vol. 1. Among the nonionic surface active agents described in the above-mentioned references, those capable of satisfying the above described conditions are preferably employed in connection with the present invention. The nonionic surface active agents can be used individually or as a mixture of two or more of them.

The polyethylene glycol type nonionic surface active agents are generally used in an amount of less than 100% by weight, and preferably less than 50% by weight, based on hydrophilic binder present.

The light-sensitive material used in the present invention may contain, if desired or necessary, various additives known for heat developable light-sensitive materials and may have a layer or layers other than the light-sensitive layer, for example, an antistatic layer, an electrically conductive layer, a protective layer, an intermediate layer, an antihalation layer, a strippable layer, etc.

If necessary, two or more layers may be applied at the same time by the method as described in U.S. Pat. No. 2,761,791 and British Pat. No. 837,095.

In the case of dry silver imageable articles, the latent image obtained after exposure of the heat-sensitive material can be developed by heating the material at a moderately elevated temperature of, for example, about 80° to about 250° C., for about 0.5 second to about 300 seconds. By increasing or decreasing the heating time, the temperature may be higher or lower within the above range. Temperatures in the range of about 110° to about 160° C. are especially useful. Heating may be carried out by the usual heating means such as a hot plate, an iron, a hot roller, a heat generator using carbon or titanium white, or the like.

Heating for transfer of the dyes can be effected by using the same heating means as exemplified for the heat development. To increase the quality of the dye image transferred to the dye receiving layer, it is preferred to prevent an increase in fogging by the occurrence of unnecessary development during dye transfer. For this purpose, it is especially effective to include a compound that reacts with the silver halide and/or can have the silver halide adsorbed thereon as a development stopping agent and/or an antifoggant in any one of the layers constituting the dye receiving material. Such a compound is preferably included in the dye receiving layer or a layer provided above the dye receiving layer, such as a protective layer, because it rapidly inhibits excessive development of the light-sensitive layer during transfer of the dye by heating and a sharp and clear dye image can be obtained. Such compounds include, for example, a nitrogen-containing heterocyclic compound, preferably a 5- or 6-membered heterocyclic compound containing a nitrogen atom.

While the present invention has been applied in the specific case of a dry silver imageable articles, it is anticipated that the benefits observed in that case will be observed in other imageable applications as well. These would include, for example, thermographic and photothermographic constructions, photographic constructions, lithographic constructions, and all imageable systems wherein an interlayer or a protective barrier topcoat layer is beneficial. Additionally, it is envisioned that the protective barrier coat taught in the present invention is useful as protective coatings for non-imageable applications as well, such as in paints, and varnishes.

The following non-limiting examples further illustrate the present invention.

EXAMPLES

The materials used below were available from standard vendors such as Aldrich Chemical Co. (Milwaukee, Wis.), unless otherwise specified.

The dyes referred to in the following examples have the following structural formulae:

Magenta masking dye:

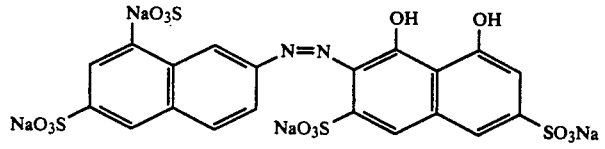

CDS 14:

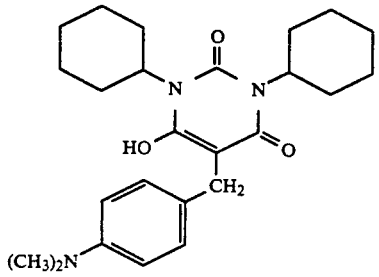

Hydroxy cyan leuco dye:

-continued

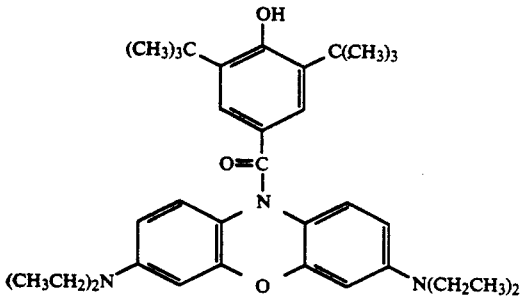

Ethyl ketazine (disclosed in U.S. Pat. No. 4,594,307):

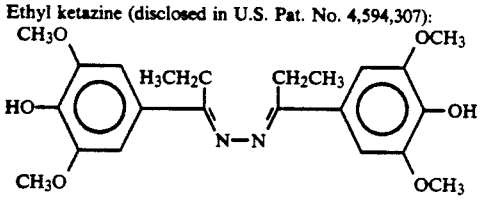

MSD 96 (disclosed in U.S. Pat. No. 4,594,307):

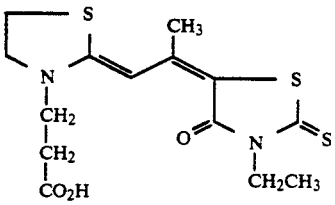

MSD 563 (disclosed in U.S. Pat. No. 3,719,495):

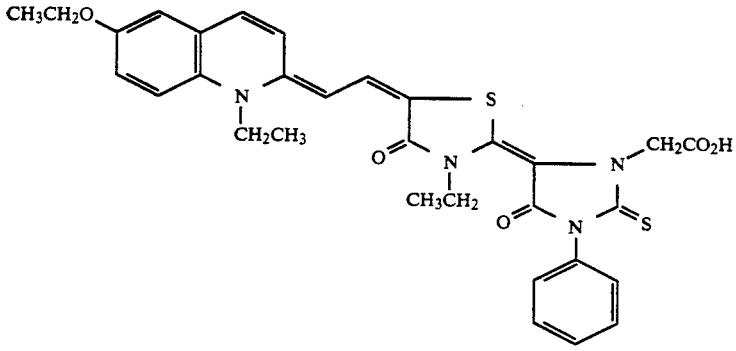

MSD 454 (disclosed in U.S. Pat. No. 4,123,282):

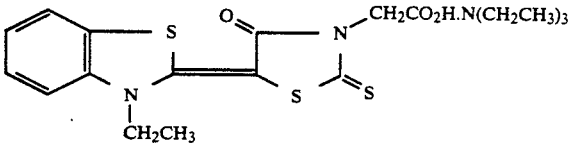

EXAMPLE 1

This example demonstrates the preparation of a dry silver tri-pack construction that does not employ the interpolymer complexes of the present invention.

A cyan homogenate was prepared as follows:

A dispersion of 8.8 parts toluene, 79.6 parts ethanol, and 10.8 parts silver behenate half soap was mixed for 60 minutes. BUTVAR B-72 (0.76 parts, a polyvinyl butyral resin with 80 mol % vinyl butyral units, 17.5 mol % vinyl alcohol units, and 2.5 mol % vinyl acetate units, M.W.=180,000-270,000 g/mol, available from Monsanto Company, St. Louis, Mo.) was added and mixing was continued for 30 minutes. The resultant dispersion was homogenized by extrusion at 8000 psi and 4.4° C. and then by a second extrusion process at 4000 psi and 21.1° C.

Yellow and magenta homogenates were prepared as follows:

A dispersion of 81.0 parts toluene, 9.0 parts acetone, and 10.0 parts silver behenate half soap was mixed for 60 minutes. The resultant dispersion was homogenized by extrusion at 8000 psi and 4.4° C. and then by a second extrusion process at 4000 psi and 21.1° C.

A magenta topcoat solution was prepared by combining 36.0 parts toluene, 36.0 parts methyl ethyl ketone (MEK), 24.7 parts STYRON 685D (a polystyrene resin, available from Dow Chemical, Midland, Mich.), ACRYLOID B66 (a methyl methacrylate/butyl methacrylate copolymer, available from Rohm & Haas, Philadelphia, Pa.).

The cyan topcoat solution was prepared as follows:

A solution was prepared by combining 34.7 parts ethanol, 39.5 parts methanol, 1.4 parts SYLOID 244 (an amorphous silica with an average particle diameter of 4 μm, available from W. R. Grace & Company, Boca Raton, Fla.), and 2.04 parts SCRIPSET 640 (a mixed methyl and isobutyl partial ester of poly(styrene-co maleic anhydride, M.W.=225,000 g/mol, $T_g$=149° C., available from Monsanto Company, St. Louis, Mo.) and mixing the solution until homogeneous. Phthalic acid (1.7 parts) was dissolved in the solution. Benzotriazole (0.17 parts) was then dissolved in the solution. A solution of 0.5 parts FC-431 (a fluorocarbon surfactant supplied as a 50% solids solution in ethyl acetate, available from 3M Company, St. Paul, Minn.) and 0.5 parts methanol was added to the solution. Finally, 19.4 parts SCRIPSET 640 was added to the solution which was then mixed until uniform.

A yellow topcoat solution was prepared as follows:

To 46.4 parts deionized water was added in order 7.3 parts VINOL 523 (a polyvinyl alcohol resin, medium molecular weight, 87–89% hydrolysis, available from Air Products & Chemicals Co., Allentown, Pa.), 43.6 parts methanol, 0.06 parts phthalazine, 0.0008 parts benzotriazole, a solution of 0.06 parts tetrachlorophthalic acid in 1.35 parts methanol, 0.003 parts magenta masking dye in 0.83 parts deionized water, and 0.35 parts sodium acetate. The mixture was stirred to completely dissolve the components at each step of the addition process.

A magenta emulsion was prepared as follows:

To 30.4 parts magenta homogenate was added in order 0.02 parts BUTVAR B-76 (a polyvinyl butyral resin, M.W.=50,000 g/mol, available from Monsanto Company); 0.03 parts mercuric acetate in 0.59 parts methanol; 0.03 parts calcium bromide in 1.00 parts ethanol; 4.0 parts BUTVAR B-76; a solution of 0.6 parts ethyl ketazine, 0.9 parts 1(2H)-phthalazinone, 44.2 parts tetrahydrofuran, and 4.4 parts MEK; 2.2 parts UCAR VAGH (a vinyl acetate/vinyl chloride copolymer, M.W.=23,100 g mol, available from Union Carbide Corp., Danbury, Conn.); 9.4 parts BUTVAR B-76, and 0.0006 parts MSD96 in 1.2 parts ethanol. Mixing was performed at each step of the addition to achieve a homogeneous solution.

A cyan emulsion was prepared as follows:

To 20.9 parts cyan homogenate was added in order 37.1 parts ethanol, 15.7 parts isopropyl alcohol, 0.01 parts mercuric bromide in 0.6 parts methanol, 7.4 parts BUTVAR B-72, 2.5 parts ACRYLOID B72 (an ethyl methacrylate copolymer, available from Rohm & Haas Company), 0.8 parts hydroxy cyan in 12.0 parts toluene, 0.0004 parts MSD563 in 0.6 parts methanol and 1.8 parts toluene. Mixing was performed at each step of the addition to achieve a homogeneous solution.

A yellow emulsion was prepared as follows:

To 21.5 parts yellow homogenate was added in order 13.3 parts MEK; 18.5 parts isopropyl alcohol; 0.07 parts BUTVAR B-76; a solution of 0.02 parts pyridine and 0.1 part MEK; 0.02 parts mercuric bromide in 0.5 parts ethanol; 0.03 parts calcium bromide in 1.0 parts ethanol; 0.002 parts MSD454 sensitizing dye in 1.1 parts toluene; and 3.3 parts ethanol, 3.6 parts PVP K90 (poly(N-vinylpyrrolidone, M.W.=360,000, available from GAF Corp., Wayne, N.J.), 4.5 parts BUTVAR B76; a solution of: 0.7 parts tribenzylamine, 0.2 parts 1(2H)phthalazinone, 15.3 parts MEK, and 15.3 parts ethanol; and 0.8 parts CDS14. Mixing was performed at each step of the addition to achieve a homogeneous solution.

A dry silver color film was prepared by a sequentially coating an opaque primed polyethylene terephthalate (ICI944, available from ICI of Wilmington, Del.) substrate a yellow emulsion layer, a yellow topcoat layer, a magenta emulsion layer, a magenta topcoat layer, a cyan emulsion layer, and a cyan topcoat layer. The coating was accomplished with a knife coater. The coating weights of the individual layers was as follows:

| | |
|---|---|
| yellow emulsion | 0.50 g/ft$^2$ |
| yellow topcoat | 0.18 g/ft$^2$ |
| magenta emulsion | 0.60 g/ft$^2$ |
| magenta topcoat | 0.45 g/ft$^2$ |
| cyan emulsion | 0.30 g/ft$^2$ |
| cyan topcoat | 0.45 g/ft$^2$ |

EXAMPLE 2

This example demonstrates the improved performance obtained by employing the interpolymer complexes used in the present invention.

A dry silver tri-pack construction was made according to the procedure of Example 1 except that 0.2 parts of polyacrylic acid (M.W.=250,000 g/mole) were added to the yellow topcoat solution.

The coated tri-pack constructions of Examples 1 and 2 were exposed for $1\times10^{-3}$ seconds to a filtered xenon flash light source. A continuous wedge was used for each filter. Three narrow bandpass filters were used: Blue for the filter with a peak at 450 nanometers; green for the filter with a peak at 540 nanometers; and red for the filter with a peak at 610 nanometers. Samples were processed for 6 sec. at 135° C. after being exposed. The developed samples were then analyzed through a computer densitometer. Results are shown in Table 1.

TABLE 1

| Sample | Filter | $D_{min}$ | $D_{max}$ | Speed Point | Contrast | Notes |
|---|---|---|---|---|---|---|
| Tri-pack Example 1 | Red | 0.16 | 2.19 | 2.31 | 4.04 | no blister, no edge fog |
| | Green | 0.16 | 2.06 | 1.89 | 2.40 | |
| | Blue | 0.15 | 1.86 | 2.05 | 2.05 | |
| Tri-pack Example 2 | Red | 0.16 | 2.18 | 2.32 | 4.10 | no blister, no edge fog |
| | Green | 0.16 | 2.01 | 2.18 | 1.95 | |
| | Blue | 0.14 | 1.61 | 1.91 | 1.60 | |
| Tri-pack of Example 1 after one week in 80% Relative humidity and 22.2° C. | Red | 0.18 | 2.18 | 2.27 | 2.48 | severe blister, (2.5 cm diameter), severe edge fog |
| | Green | 0.24 | 2.03 | 1.28 | 1.02 | |
| | Blue | 0.19 | 1.62 | 1.51 | 1.74 | |
| Tri-pack of Example 2 after one week in 80% relative humidity and 22.2° C. | Red | 0.17 | 2.18 | 2.30 | 2.53 | no blister, no edge fog |
| | Green | 0.18 | 2.03 | 1.57 | 1.49 | |
| | Blue | 0.16 | 1.62 | 1.56 | 1.63 | |

EXAMPLE 3

This example demonstrates the present invention in a monochrome dry silver construction.

A control sample A was prepared by coating the yellow emulsion of Example 1 onto a substrate and overcoating with the yellow topcoat of Example 1 as described in Example 1.

Sample B was prepared as sample A, but with 0.2% polyacrylic acid (M.W.=2,000 g/mol) in the topcoat.

Sample C was prepared as sample A, but with 0.2% polyacrylic acid (M.W.=5,000 g/mol) in the topcoat.

Sample D was prepared as sample A, but with 0.2% polyacrylic acid (M.W.=90,000 g/mol) in the topcoat.

Sample E was prepared as sample D, but with 0.2% BUTVAR B-76 in place of the polyvinylpyrrolidone in the yellow emulsion layer.

After coating and drying, the topcoat layers of samples A and E were water soluble, while the topcoat layers of samples B, C, and D were insoluble in water.

After exposure and processing as in Example 2, all samples had a measured $D_{min}$ of about 0.8. After 24 hours of aging at 22.2° C. and 80% relative humidity, samples A and E were both visibly fogged ($D_{min}$=1.80), while samples B, C, and D remained unchanged.

EXAMPLE 4

Three solutions were prepared as follows:

Solution A 35% poly(4-vinylpyridine) in methanol

Solution B 40% poly(2-vinylpyridine) in methanol

Solution C 5% polyacrylic acid (M.W.=250,000 g/mol) in methanol.

Sample F was prepared by coating solution A at 2 mil wet thickness onto a 0.07 mm thickness opaque primed polyester ICI 994 substrate.

Sample G was prepared by coating solution B at 2 mil wet thickness onto a 0.07 mm thickness opaque primed polyester ICI 994 substrate.

Sample H was prepared by coating solution C at 3 mil wet thickness onto the coated side of sample F.

Sample I was prepared by coating solution C at 3 mil wet thickness onto the coated side of sample G.

Samples F, G, H, and I were dried for 3 minutes at 82.2° C. After drying samples F and G were soluble in methanol, but samples H and I were insoluble in methanol.

EXAMPLE 5

This example demonstrates both the effect of using adjacent polymeric organic acid and polymeric organic base containing layers, and the applicability of the present invention to protective coatings where permeability to water vapor is undesirable.

Two solutions were prepared as follows:

Solution 1 consisted of 5% aqueous PVP K-90; and

Solution 2 consisted of 5% aqueous polyacrylic acid (MW=250,000 g/mol).

As a control sample, 0.07 mm polyethylene terephthalate that had been vapor coated aluminum (3% transmittance) was used. Coatings in samples J through M were made with a knife coater at 2 mil wet thickness onto the side of the control sample having the vapor coated aluminum.

Sample J was prepared by coating Solution 1 and drying at 82.2° C. for 3 minutes, then applying a second coating of Solution 1 onto the first one and drying at 82.2° C. for 3 minutes.

Sample K was prepared by coating Solution 2 and drying at 82.2° C. for 3 minutes, then applying a second coating of Solution 2 onto the first one and drying at 82.2° C. for 3 minutes.

Sample L was prepared by coating Solution 1 and drying at 82.2° C. for 3 minutes, then applying a second coating of Solution 2 onto the first one and drying at 82.2° C. for 3 minutes.

Sample M was prepared by coating Solution 2 and drying at 82.2° C. for 3 minutes, then applying a second coating of Solution 1 onto the first one and drying at 82.2° C. for 3 minutes.

The coating layers applied to Samples J and K (not including aluminum) were completely water soluble while those of Samples L and M formed an insoluble layer which was collected and dried (20% of weight of the dried coating).

The sides of Samples J through M and the control that had the aluminum vapor coated layer were subjected to steam vapor from boiling water to measure the time required for the aluminum layer to become transparent by oxidation and hydrolysis. The requisite times for the samples to become transparent are given in Table 2.

TABLE 2

| Sample | Time Required for Transparency |
|---|---|
| Control | 2 min |
| J | 15 min |
| K | 4 min |
| L | 30 min |
| M | 45 min |

EXAMPLE 6

This example demonstrates the applicability of the present invention to protective coatings in which organic solvent permeability is undesirable. Four samples were prepared as follows:

As a control sample a solution of 0.5 wt % ethyl ketazine (a leuco dye) and 10 wt % BUTVAR B-76 in tetrahydrofuran was coated onto an opaque polyethylene terephthalate base (ICI994, ICI) at 0.07 mm wet thickness. Coatings in samples N through Q were made with a knife coater and dried at 82.2° C. for 3 minutes.

Sample N was prepared by coating the control sample at 4 mil wet thickness with a 30 wt % methanolic solution of poly(4-vinylpyridine) (Reilline 4200, Reilly Tar and Chemical Corp.).

Sample O was prepared by coating the control sample at 2 mil wet thickness with a 30 wt % methanolic solution of poly(4-vinylpyridine) (Reilline 4200, Reilly Tar and Chemical Corp.) then overcoating the poly(4-vinylpyridine) layer at 2 mil wet thickness with a 5 wt % methanolic solution of polyacrylic acid (M.W.=250,000 g/mol).

Sample P was prepared by coating the control sample at 4 mil wet thickness with a 5 wt % methanolic solution of polyacrylic acid (M.W.=250,000 g/mol).

A test solution consisting of 1 wt % N-bromosuccinimide (an oxidizing agent) in acetone/methanol (1:1 by volume) was prepared. One drop of the solution was applied to the surface of each of the samples N through P and the control. Formation of a magenta color indicate results from interaction of the leuco dye with the oxidizing agent. The control sample and Samples N and P gave dark color formation while Sample O remained colorless. When toluene, tetrahydrofuran, or MEK were used as the solvent of the 1 wt % N-bromosuccinimide solution Sample D remained colorless.

Sample O was heated to 139° C. for 10 seconds and the test was repeated with the same result. This demonstrated that neither diffusion of the leuco dye in the bottom layer to the top layer, or diffusion of the N-bromosuccinimide solution to the bottom layer occurred.

Reasonable variations and modifications of the foregoing disclosure are possible without departing from either the spirit or scope the present invention as defined by the claims.

We claim:

1. A photothermographic article comprising a barrier layer which comprises a layer comprising an acidic polymer containing carboxyl and/or sulfo groups, said layer comprising an acidic polymer being adjacent to another layer comprising a basic polymer capable of forming hydrogen bonds with said acidic polymer, wherein said photothermographic article also comprises one or more imaging layers coated on a substrate, each of said imaging layers comprising: light-sensitive silver halide; light-insensitive, reducible silver source; and reducing agent for silver ion; and wherein said barrier layer is positioned on the same side of said substrate as said imaging layers.

2. The photothermographic article according to claim 1 wherein said acidic polymer is chosen from the group consisting of: poly(acrylic acid) and poly(methacrylic acid).

3. The photothermographic article according to claim 1 wherein said basic polymer is chosen from the group consisting of: polyvinylpyrrolidone and polyvinylpyridine.

4. The photothermographic article according to claim 1 wherein said light-sensitive silver halide comprises silver chloride, silver bromide, silver iodide, or mixtures thereof.

5. The photothermographic article according to claim 1 wherein said light-insensitive, reducible silver source material comprises silver behenate.

6. The photothermographic article according to claim 1 wherein said reducing agent comprises leuco dye.

7. The photothermographic article according to claim 1 wherein said barrier layer is employed as a coating on the imaging layer located farthest from said substrate.

* * * * *